US006441793B1

(12) United States Patent
Shea

(10) Patent No.: US 6,441,793 B1
(45) Date of Patent: Aug. 27, 2002

(54) METHOD AND APPARATUS FOR WIRELESS COMMUNICATIONS AND SENSING UTILIZING A NON-COLLIMATING LENS

(75) Inventor: Donald Shea, Plano, TX (US)

(73) Assignee: Austin Information Systems, Inc., Austin, TX (US)

( * ) Notice: Subject to any disclaimer, the term of this patent is extended or adjusted under 35 U.S.C. 154(b) by 0 days.

(21) Appl. No.: 09/578,161

(22) Filed: May 23, 2000

Related U.S. Application Data

(60) Provisional application No. 60/190,227, filed on Mar. 16, 2000.

(51) Int. Cl.[7] ..... H01Q 19/19
(52) U.S. Cl. ..... 343/753; 343/755
(58) Field of Search ..... 343/753, 909, 343/911 R, 911 L, 755, 781 R, 754, 776, 779

(56) References Cited

U.S. PATENT DOCUMENTS

| | | | | | |
|---|---|---|---|---|---|
| 4,041,499 | A | | 8/1977 | Liu et al. | 343/756 |
| 4,092,648 | A | | 5/1978 | Fletcher et al. | 343/782 |
| 4,194,209 | A | * | 3/1980 | Coulbourn, Jr. | 343/753 |
| 4,218,683 | A | * | 8/1980 | Hemming | 343/703 |
| 4,769,646 | A | * | 9/1988 | Raber et al. | 343/753 |
| 5,041,840 | A | | 8/1991 | Cipolla et al. | 343/725 |
| 5,107,274 | A | | 4/1992 | Mitchell et al. | 343/756 |
| 5,206,658 | A | * | 4/1993 | Wokurka | 343/755 |
| 5,635,944 | A | | 6/1997 | Weinstein et al. | 343/776 |
| 5,691,736 | A | * | 11/1997 | Hunn et al. | 343/872 |
| 5,784,033 | A | | 7/1998 | Boldissar, Jr. | 343/786 |
| 5,793,335 | A | | 8/1998 | Anderson et al. | 343/786 |
| 5,818,396 | A | | 10/1998 | Anderson et al. | 343/786 |
| 6,052,099 | A | * | 4/2000 | Imaizumi et al. | 343/840 |

OTHER PUBLICATIONS

Koch, "Coaxial Feeds for High Aperture Efficiency and Low Spillover of Paraboloidal Reflector Antennas," IEEE Transactions on Antennas and Propagation, vol. AP–21, No. 2, Mar. 1973, pp. 164–169.

* cited by examiner

*Primary Examiner*—Don Wong
*Assistant Examiner*—James Clinger
(74) *Attorney, Agent, or Firm*—Eric B. Meyertons; Conley, Rose & Tayon, P.C.

(57) ABSTRACT

An antenna feed system capable of simultaneously transmitting and receiving in multiple frequency bands. In one embodiment, the feed system comprises a non-collimating lens attached to the emitting end of a broad-band antenna feed. The lens is positioned to receive and focus the broad-band wireless signals from any reflector configuration to any antenna feed. It is also positioned to transmit and focus the broad-band wireless signals from any antenna feed to any reflector configuration. A method for illuminating a reflector configuration through an antenna feed with the lens is disclosed. A wireless sensor system is also disclosed. In one embodiment, the non-collimating lens may be used as part of a wireless signal sensor unit used to increase or decrease the angular aperture of the sensor unit.

39 Claims, 11 Drawing Sheets

| x | y |
|---|---|
| 0.000 | 0.000 |
| 0.003 | 0.093 |
| 0.006 | 0.185 |
| 0.012 | 0.278 |
| 0.021 | 0.370 |
| 0.033 | 0.462 |
| 0.047 | 0.554 |
| 0.063 | 0.645 |
| 0.082 | 0.736 |
| 0.103 | 0.826 |
| 0.127 | 0.916 |
| 0.156 | 1.004 |
| 0.182 | 1.093 |
| 0.213 | 1.180 |
| 0.248 | 1.267 |
| 0.280 | 1.353 |
| 0.317 | 1.438 |
| 0.356 | 1.522 |
| 0.396 | 1.606 |
| 0.439 | 1.688 |
| 0.483 | 1.770 |
| 0.528 | 1.850 |
| 0.575 | 1.930 |
| 0.624 | 2.009 |
| 0.674 | 2.087 |
| 0.725 | 2.165 |
| 0.777 | 2.241 |
| 0.830 | 2.317 |
| 0.885 | 2.392 |
| 0.940 | 2.467 |
| 0.996 | 2.541 |
| 1.052 | 2.614 |
| 1.109 | 2.687 |
| 1.167 | 2.760 |
| 1.225 | 2.832 |
| 1.283 | 2.904 |
| 1.342 | 2.976 |
| 1.401 | 3.048 |
| 1.459 | 3.120 |
| 1.518 | 3.191 |
| 1.577 | 3.263 |
| 1.635 | 3.335 |
| 1.694 | 3.407 |
| 1.751 | 3.480 |
| 1.809 | 3.553 |
| 1.865 | 3.626 |
| 1.921 | 3.700 |

Fig. 7

METHOD AND APPARATUS FOR WIRELESS COMMUNICATIONS AND SENSING UTILIZING A NON-COLLIMATING LENS

REFERENCE TO FIRST APPLICATION

This application claims the benefit of U.S. Provisional Application No. 60/190,227, filed Mar. 16, 2000.

BACKGROUND

1. Field of the Invention

This invention relates generally to the field of wireless communications and, more particularly, to antenna systems.

2. Description of the Related Art

Satellite communication systems are commonly employed to globally transmit data signals from an originating destination to a receiving destination. FIG. 1 shows a conventional satellite communication system. For an uplink operation, where communications signals are transmitted by a ground station 110 to a satellite 109, a data signal is first sent to a modulator circuit 112 in the ground station 110. From this data signal, modulator circuit 112 generates a modulated carrier signal with a frequency in one of the desired frequency bands. The modulated carrier signal is then sent to an input port on a waveguide assembly, commonly called an antenna feed 102. Antenna feed 102 is typically positioned such that its radiated output is efficiently coupled to a system of one or more reflector units 100. Antenna feed 102 acts as a transducer that converts the modulated carrier signal into radiated electromagnetic waves 114 that illuminate reflector unit 100. The electromagnetic waves 114 are then directed by the reflector unit 100 to satellite 109.

For a downlink operation, where communication signals are transmitted by satellite 109 to ground station 110, the above process occurs in reverse. Radiated electromagnetic waves of a modulated carrier wave are transmitted from satellite 109 to reflectors 100. The waves are redirected by reflectors 100 into antenna feed 102. Antenna feed 102 then acts as a transducer to route the received signals to appropriate receiver ports. Waveguide may couple the receiver ports to a demodulator circuit 112. Demodulator circuit 112 receives the carrier signal and recovers the data transmitted by satellite 109 by extracting the underlying data signal from the modulated carrier wave.

Satellite communication systems commonly employ more than one frequency band for electromagnetic signals radiated from a transmitting station to a receiving station through a satellite orbiting above the earth. These systems typically convey information on carrier signals in a number of different frequency bands approved by regulatory organizations and standards bodies (e.g., the Federal Communications Commission or FCC in the United States). Among the most widely implemented bands are the C band, X band and Ku band. These three bands together extend over two octaves of the communication frequency spectrum. The C band comprises frequencies in the range from 3.625 GHz to 6.425 GHz. The X band comprises frequencies in the range from 7.250 GHz to 8.40 GHz. The Ku band comprises frequencies in the range from 10.950 GHz to 14.500 GHz. The C, X and Ku bands are typically subdivided into many sub-bands wherein uplink and downlink data streams independently reside. Satellite communication systems employing single band communications are commonly referred to as narrow-band wireless signal communications. Multi-band communication systems are commonly referred to as broadband wireless signal communications.

FIG. 2 shows an antenna system 90 utilizing an antenna feed 102. Antenna system 90 includes a main reflector 100, a subreflector 101 and an antenna feed 102. Support member 105 supports subreflector 101 and antenna feed 102. Waveguides 107 connect antenna feed 102 to a plurality of transceivers 108. While three transceivers are shown, other combinations of receivers are possible. The use of subreflector 101 may be optional in some configurations. The main reflector 100, subreflector 101 and antenna feed 102 may be positioned in a prime focus, single offset, dual offset, Gregorian, Cassegrain, or Newtonian configuration. In the case of a prime focus configuration, subreflector 101 is removed. Main reflector 100 is typically paraboloidal, and subreflector 101 is typically hyperboloidal, but other shapes may also be used.

Prior art systems have typically relied on separate antenna feeds for transmission and/or reception of the C, X, and Ku frequency bands, i.e., a C-band antenna feed with its own input/output (I/O) port to transmit or receive in the C-band; a X-band antenna feed with its own I/O port to transmit or receive in the X-band; and a Ku-band antenna feed with its own I/O port to transmit or receive in the Ku-band. Since three separate antenna feed structures are needed, data transmission or reception in different frequency bands requires the physical removal of the first frequency antenna feed from the focal point of the reflector and the physical installation of a second frequency antenna feed into the focal point of the reflector. This movement is both a time consuming and tedious operation, in which improper alignment of the reflector and the antenna feed will cause distorted radiated patterns of the transmitted electromagnetic waves and may reduce transmission or reception efficiency. In addition, the distorted radiated patterns may be severe enough to violate FCC regulations. In order to prevent such problems, tests may be conducted after a switch is made from one antenna feed to another to obtain actual radiated patterns. This testing process may itself take several days to complete. Consequently, many ground stations limit their transmission or reception frequency to one of the three bands C, X and Ku. In addition, in the case of mobile satellite communications, there is a need for minimization of transportable payload weight in space or on earth. The use of multiple antenna feeds for communications at various frequencies may detrimentally increase payload weight and limit their usefulness on ground stations where size may be of highest importance.

Thus, a multi-band antenna feed structure capable of operating in two or more frequency bands simultaneously without the need for manual intervention is desirable. Such a feed structure may advantageously require fewer parts and consequently reduces depot supplies and training requirements. In the prior art, multi-band antenna feed structures have been recited. One such example is disclosed in co-pending U.S. patent application Ser. No. 09/183,355 filed on Oct. 30, 1998, entitled, "A Method and Apparatus for Transmitting and Receiving Multiple Frequency Bands Simultaneously" by Cavalier, et al., which is hereby incorporated herein by reference in its entirety. Cavalier, et al. teaches a multi-band antenna feed structure capable of simultaneous transmission and reception in the C, X, and Ku frequency bands. The structure, comprising coaxial waveguides and a subreflector, is preferably mated with parabolic reflectors. FIG. 3 shows a cross-section of one embodiment of a multi-band antenna feed 102 capable of transmitting and receiving C, X, and Ku frequency bands as according to Cavalier, et al.

When an antenna feed is designed for a reflector system, the matching of the antenna pattern to the angular aperture of the reflector is of primary concern. If the antenna pattern is too wide, the radiated electromagnetic energy spills over the edge of the reflector, and may result in reduced efficiency of the antenna system. This is commonly referred to as over-illumination of the reflector system. In addition, the energy lost due to the over-illumination result in side lobes that interfere with other neighboring antenna systems. Thus, stringent rules about an antenna's spillover characteristics are enforced by the governmental agencies regulating the antenna systems. Conversely, if the antenna pattern is too narrow, the reflector is under-illuminated. This also results in reduced efficiency of the antenna system. The use of under-illuminated reflectors is generally avoided to minimize system cost and transportability. In addition, physical space constraints on the antenna system may prohibit the use of large reflectors. An ideally illuminated reflector matches the angular aperture of the reflector to the entire antenna radiation pattern being generated by the antenna feed, thereby providing optimum transmission and reception efficiency in the smallest footprint possible.

Traditional antenna feeds are typically designed for narrow band communications. They commonly employ collimating lenses or corrugated horns with the appropriate aperture size to produce the desired pattern beamwidth. Because they are designed to meet a specific beamwidth and frequency band, the antenna feed designs are relatively straightforward for one skilled in the art. Corrugated horns and/or collimating lenses have been used to assist in attaining the desired pattern beamwidth. However, the use of corrugated horns or collimating lens is not suitable for multi-band communications because their pattern beamwidth is a function of frequency. For example, if the pattern beamwidth being generated is ideal at one frequency, it is too narrow at higher frequencies and too wide at lower frequencies, resulting in poor illumination efficiency for multi-band communications.

The antenna feeds that have been designed for multi-band communications inherently generate broad pattern beamwidths, which severely limit their applications to prime focus reflector systems. For reflector systems requiring narrow beamwidth patterns, such as long-focal length single offset, folded double offset, and Cassegrain reflectors, these prior art broad-band, broad-beamwidth antenna feed systems are ill-suited to provide the desired optimum illumination efficiency. Accordingly, it would be highly desirable to provide a multi-band antenna feed system which produces narrow pattern beamwidths at multiple operating frequencies to maximize illumination efficiency and minimize the formation of side lobes. It would be further desirable to implement a multi-band, narrow beamwidth antenna feed system that avoids physical reconfiguration of the system for different operating frequencies and that minimizes the physical size of the system.

SUMMARY OF THE INVENTION

The problems outlined above may at least in part be solved by employing a non-collimating lens to produce narrow pattern beamwidths at multiple operating frequencies. Advantageously, an antenna system with such a lens may be able to transmit and receive broadband wireless signals with closer to maximize illumination efficiency of many reflector configurations. Such an antenna system may also minimize the formation of side lobes. In addition, the system may avoid the need for physical reconfiguration of the system for different operating frequencies, and it may reduce the system footprint by eliminating the need for a plurality of antenna feeds to handle the different operating frequencies.

A method for simultaneously transmitting and receiving broadband wireless signals is contemplated. In one embodiment, the method comprises generating a broadband wireless signal with an antenna feed and propagating the signal through a non-collimating lens. In one embodiment, the antenna feed is a tri-feed antenna feed. The lens is configured to focus the broadband wireless signal in a non-collimating manner and reflect the focused signal with a reflector for transmission. The method further comprises reflecting a received broadband wireless signal from the reflector and propagating the received signal through the lens. The lens is configured to focus the broadband wireless signal in a non-collimating manner to the antenna feed system. In one embodiment, the lens may be a planar convex configuration. In another embodiment, the lens may be meniscus. In some embodiments, the lens is configured to be attached to the front end of the antenna feed system. In other embodiments, the lens is configured to be attached in a cavity of the front end of the antenna feed system. The front end of the antenna feed system is the location where broadband wireless signals are both transmitted and received. In one embodiment, the lens may be formed of Rexolite. In other embodiments, the lens may be formed of fused quartz, teflon, polyethylene, or other materials.

A system for simultaneously transmitting or receiving broadband wireless signals is also contemplated. In one embodiment, the system comprises an antenna feed, a lens and a reflector. For transmitting, the antenna feed is configured to propagate the signals through a non-collimating lens. The lens is positioned to receive and focus the signals from the antenna feed to a reflector, which in turn may be positioned to receive and reflect the focused signal from the antenna feed. For receiving, the reflector is positioned to receive and reflect the signal through the non-collimating lens. The lens is positioned to receive and focus the signal from the reflector to the antenna feed, which is configured to propagate the focus signal from the lens.

A system for increasing sensitivity for a wireless sensor is also contemplated. In one embodiment, the system comprises a non-collimating lens configured to receive wireless signals and focus the signals onto a sensor. The sensor is positioned to receive the focused signal once it has passed through the lens. In one embodiment, the lens may be part of a nose cone, and the wireless sensor may be part of a navigational control unit for a missile. In one embodiment, the lens may have a planar convex configuration or a meniscus configuration. Advantageously, using the lens the missile may be able to detect electromagnetic radiation sources at farther distances and may be able to detect lower level electromagnetic radiation sources. In one embodiment, the lens may be formed of Rexolite. In other embodiments, the lens may be formed of fused quartz, teflon, polyethylene, or other materials.

These and other benefits and advantages of the present invention shall become apparent from the detailed description of the invention presented below in conjunction with the figures accompanying the description.

BRIEF DESCRIPTION OF THE DRAWINGS

The foregoing, as well as other objects, features, and advantages of this invention may be more completely understood by reference to the following detailed description when read together with the accompanying drawings in which:

FIG. 7 is a table of the specifications for one embodiment of the lens design of FIG. 6.

Figure 1:
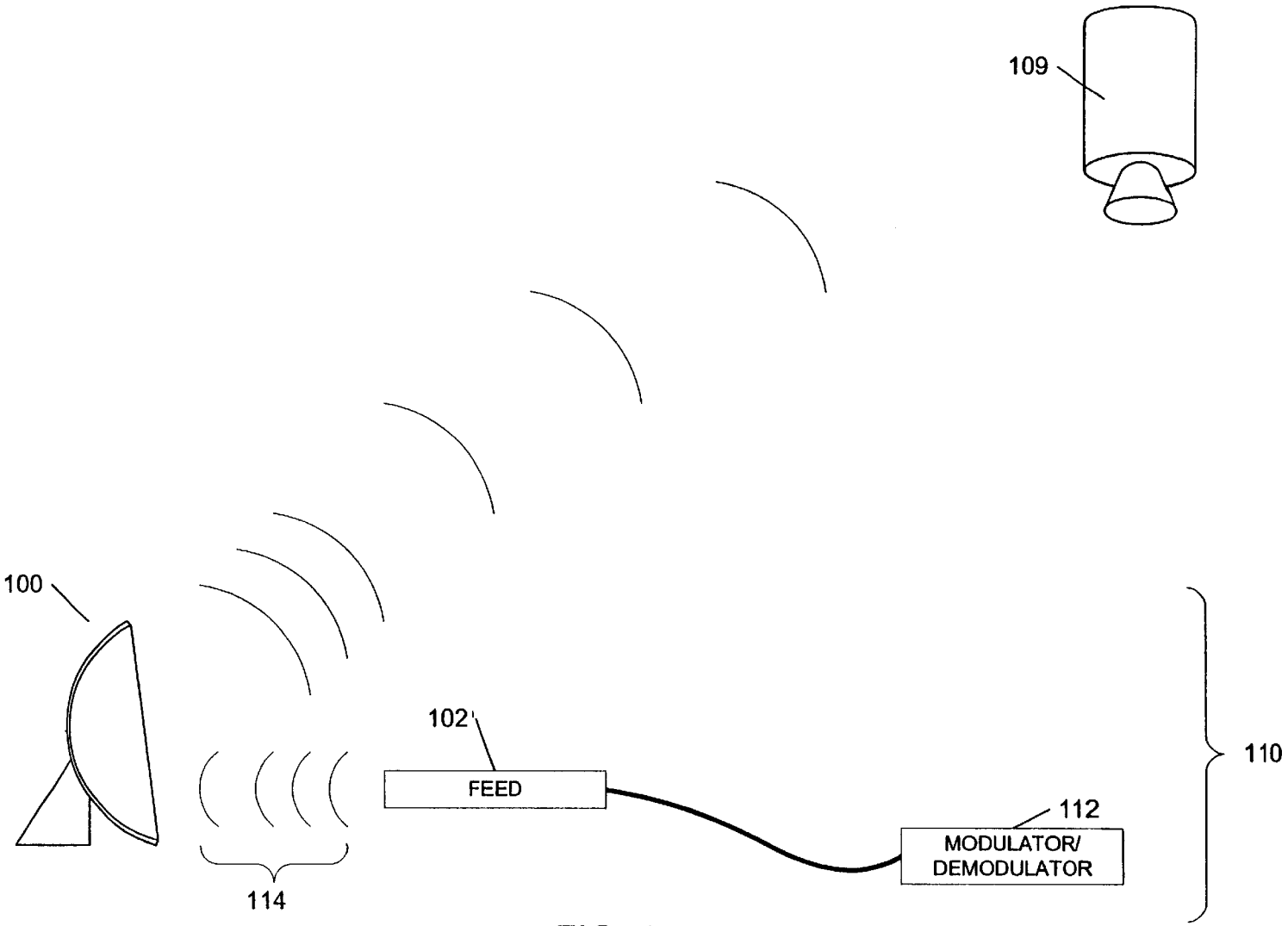
FIG. 1 shows one embodiment of a satellite communication system.
Figure 2:
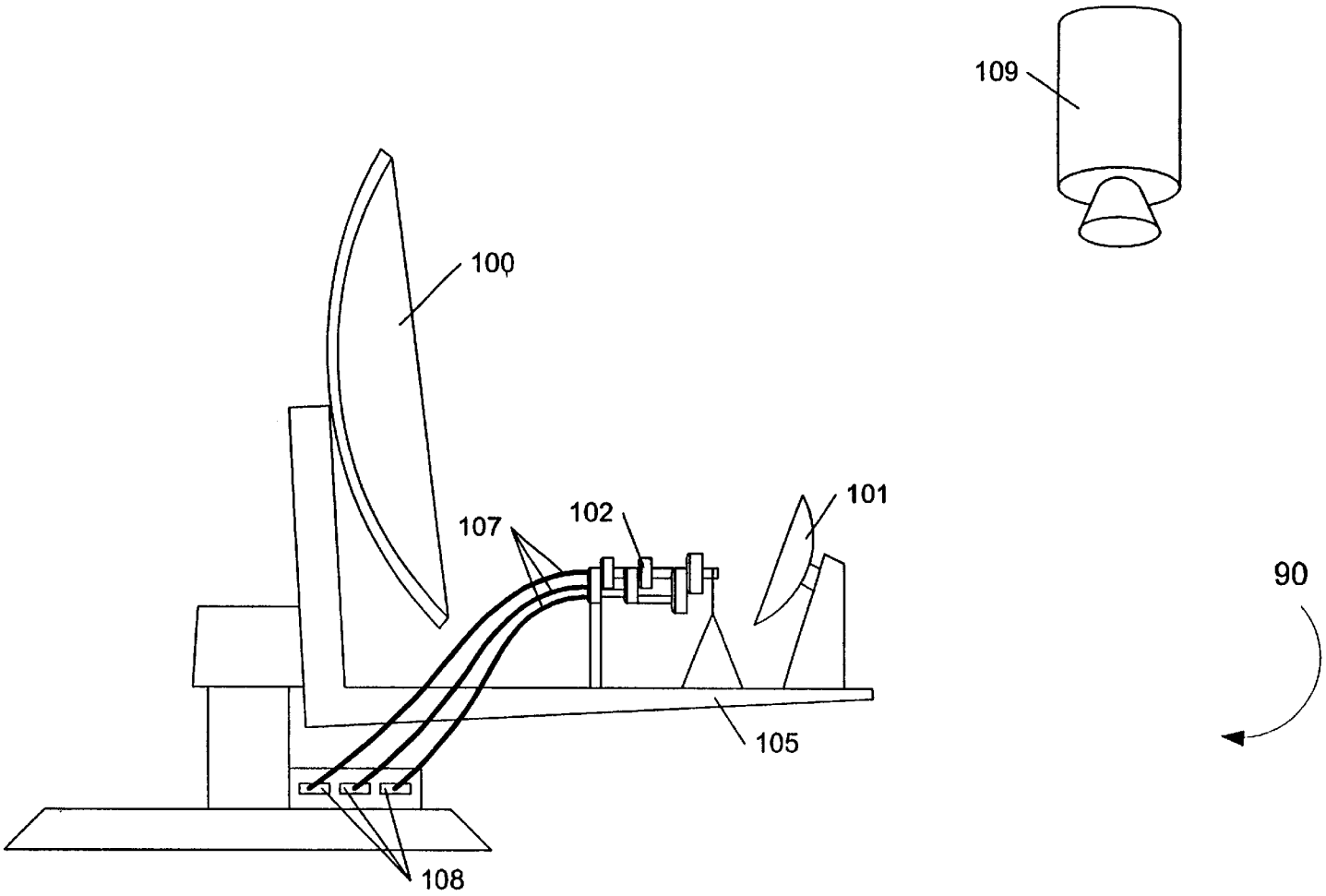
FIG. 2. is a diagram of one embodiment of a satellite antenna system utilizing one embodiment of an antenna feed.
Figure 3:
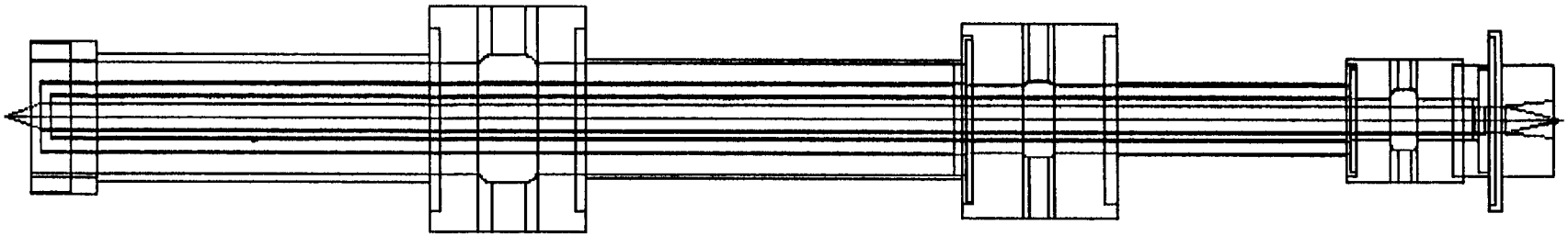
FIG. 3 is a cross-section of one embodiment of a multi-band antenna feed.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims. Please also note that the headings used herein are for organizational purposes only and are not meant to have any effect on the interpretation of the claims or the detailed description.

DETAILED DESCRIPTION OF THE PREFERRED EMBODIMENTS

Figure 4:
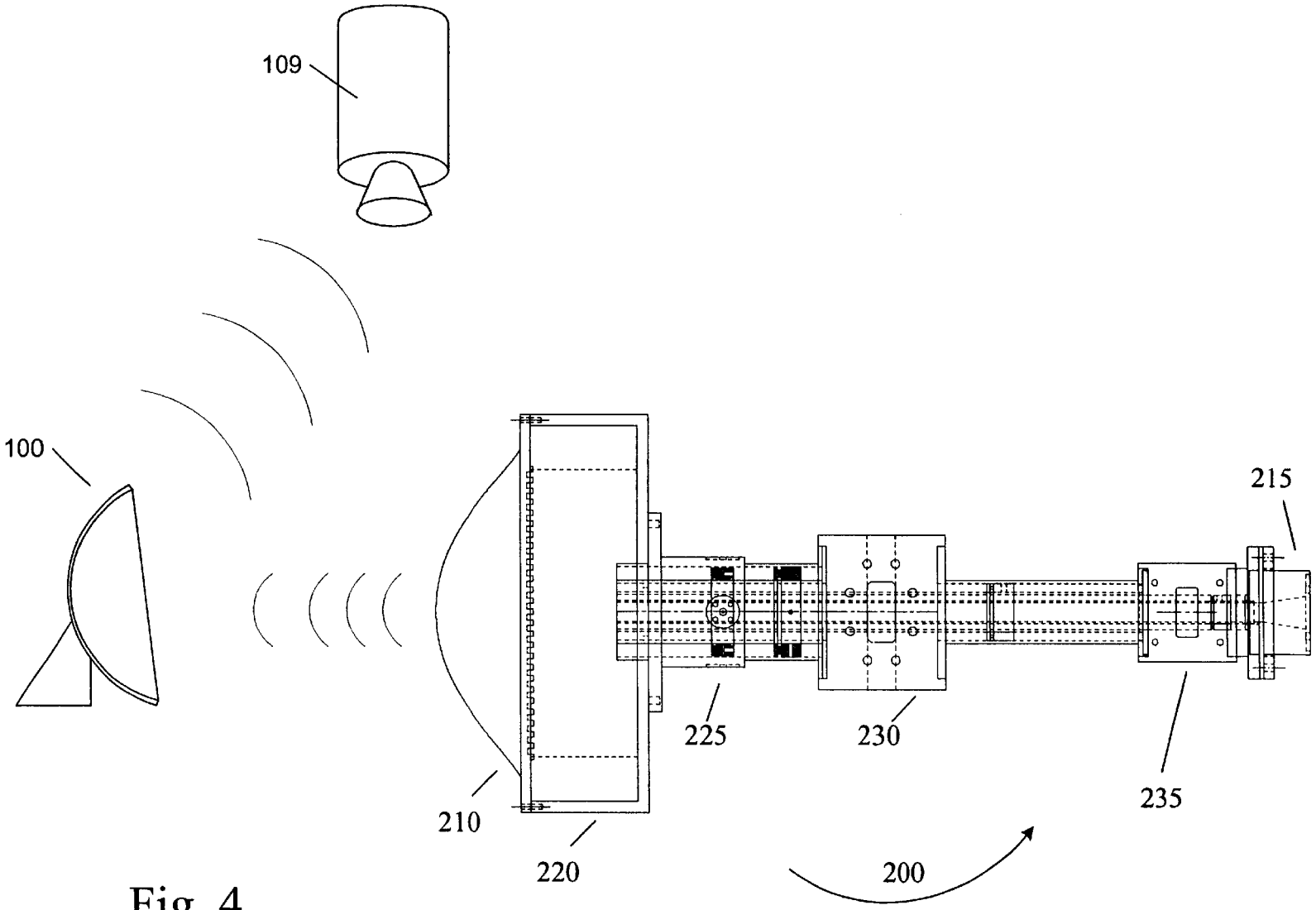
FIG. 4 is a cross-section of one embodiment of a multi-band antenna feed with one embodiment of a non-collimating lens attached.

Turning now to FIG. 4, one embodiment of a multi-band antenna feed 200 utilizing a lens 210 is shown. In the following discussion, the end of feed 200 opposite lens 210 is referred to as the rear end 215, and the end of feed 200 near lens 210 is referred to as the front end 220. The placement of lens 210 to front end 220 may vary depending on antenna feed 200's configuration to reflector 100. In one embodiment, lens 210 is attached to front end 220 of feed 200. In another embodiment, lens 210 resides in a cavity of front end 220.

In one embodiment, feed 200 is designed to transmit and receive C, X, and Ku frequency bands simultaneously. When feed 200 is used to transmit signals, electromagnetic radiation passes through 200 to front end 220, where the radiation exits feed 200 and propagates into lens 210. Lens 210 focuses the radiated beam (to illuminate reflector 100). The radiated beam is then reflected to satellite 109.

When feed 200 is used to receive signals, electromagnetic radiation is sent from satellite 109 to reflector 100. A portion of the radiation is then reflected from reflector 100 into lens 210. Lens 210 focuses the reflected radiation into front end 220 of antenna feed 200. The reflected and focused radiation propagates through feed 200 to appropriate receiving ports 225, 230, and 235.

Antenna feed 200 and lens 210 enable an antenna system (e.g. system 110) to transmit and receive signals simultaneously with optimum illumination efficiency across multiple operating frequencies. While one embodiment enables simultaneous transmission and reception of signals in the C, X, and Ku frequency bands, other embodiments may enable such simultaneous transmission and reception of signals in the L and S bands, in the Ka and Ku bands, in the C, X, Ku and Ka bands or other combination of frequency bands. Advantageously, lens 210 has applications in many different antenna systems, e.g., to match different feeds with industry standard reflectors.

Figure 5:
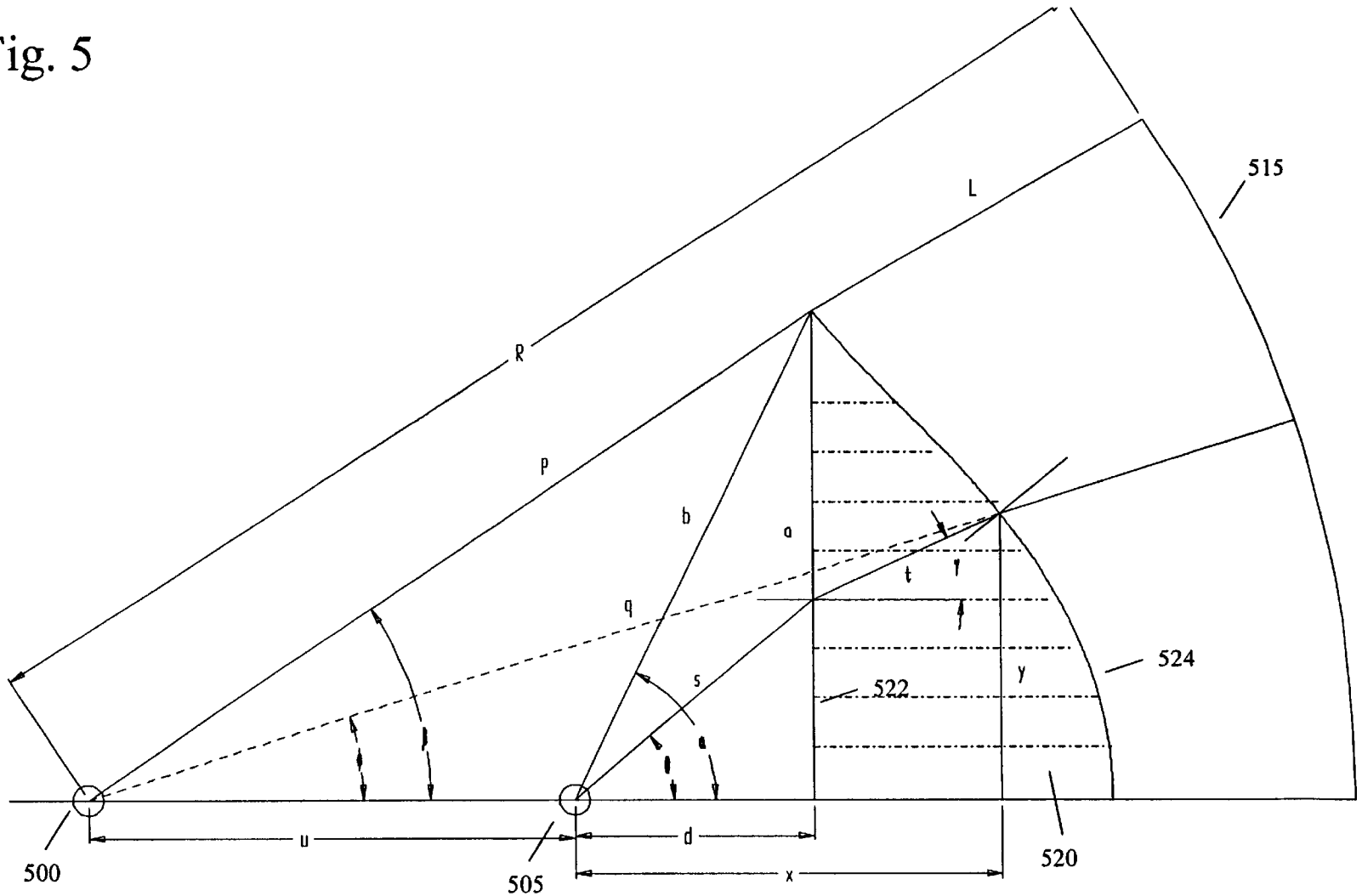
FIG. 5 is an analytical diagram for one embodiment of the lens design.

Details of several different embodiments of lens 210 will be discussed in further detail herein. While the following description details a method for transmission, it is understood that the present application is easily applicable to a method for reception. Referring now to FIG. 5, a diagram illustrating the propagation of an electromagnetic wave through lens 520 from front end 220 (from FIG. 4) of antenna feed 200 (from FIG. 4) is shown. FIG. 5 illustrates a cross-section of lens 520, which is bounded by a first surface 522 and a second surface 524, wherein first surface 522 is spaced a lateral distance, d, from the antenna feed 200's phase center 505. In some embodiments, feed 200 may be thought of as a point source positioned at phase center 505. In some embodiments, first surface 522 may be substantially planar and second surface 524 may be substantially hemispherical such that both surfaces combine to form a planar convex or planar concave lens. In another embodiment, first surface 522 and second surface 524 are both substantially hemispherical such that both surfaces combine to form a meniscus convex or meniscus concave lens. Various other non-collimating lens configurations (i.e., those capable of focusing radiation such as wireless signals, radar waves, microwaves, etc.) are also possible and contemplated.

Depending upon the exact implementation, lens 520 may be formed from a number of different materials. For example, in one embodiment, lens 520 may be formed of Rexolite, which is a form of polystyrene. In another embodiment, lens 520 may be formed of fused quartz, Teflon or polyethylene. Desirable features in a material for lens 520 may include temperature insensitivity, a homogeneous structure, low weight, good machinability, a frequency invariant dielectric constant and lossless material characteristics. As can be seen from FIG. 5, unlike prior art antenna systems using lens, lens 520 is a non-collimating or non-parallel design (i.e., the design serves to focus the waves passing through the lens). Advantageously, this non-collimating design may allow antenna feed 200 to be positioned more closely to reflector 100 while still obtaining ideal illumination at multiple frequencies. As a result, antenna system 110's size may decrease, transportability and efficiency may improve, and spill over and side lobes may be reduced.

In FIG. 5, angle $\alpha$, is the subtended feed pattern angle originating from the antenna feed phase center 505. Antenna feed phase center 505 represents the actual position of front end 220 of antenna feed 200, which may be visualized as a point source. A known desired feed pattern subtended angle, $\beta$, originates from the displaced phase center 500. Displaced phase center 500 may be thought of as the apparent location of front end 220 of antenna feed 200 (i.e., with respect to phase). Displaced phase center 500 is where the feed would have to be placed without lens 520 to achieve a similar illumination pattern on reflector 100. However, such a configuration may have a lower efficiency because less of the radiated signal from the feed would reach the reflector. The distance between antenna feed phase center 505 and displaced phase center 500 is given by u. The feed pattern subtended angle is the half beamwidth angle of the angular aperture of the reflector 100. An electromagnetic radiated wave 515 with a constant phase surface is transmitted from antenna feed 200. Ray qv represents the apparent radiated wave path that radiated wave 515 would propagate without lens 520. Conversely, ray stv is the true radiated wave path with lens 520 present. Variable a is the radius of the lens being designed and is a known value. The radius may be chosen large enough to overcome diffraction effects for all operating frequencies. In one embodiment, a lens with a radius of 4 inches is used. In some embodiments, a lens may be chosen so that the radius may be approximately three to four times the wavelength of the desired frequencies. Variable θ is the refracted angle of ray s originating at phase center 505 and may be used to enable the design of lens 520. Note, while different frequencies may propagate through lens 520 and generate different illumination patterns on reflector 100, the differences as a function of frequency are typically negligible (e.g., a second order effect). Thus, for most purposes, lens 520 may be viewed as frequency invariant.

In order to determine one possible shape of lens 520 suitable for taking a known multi-band beamwidth emanating from antenna feed 200 and illuminating reflector 100 with a known angular aperture, the following equations 1–12 may be solved for x and y. Variables x and y describe the lateral and vertical distance at any given point of lens 520 in relation to the antenna feed phase center 505. In one embodiment, the unit of measurement for x and y are in inches. However, any unit of distance measurement may be employed as long as it is uniformly applied to all distance variables in the solution for the lens design.

It can be seen that a signal from antenna feed phase center 505 propagating along the path of radiated wave 515 travels a distance equal to:

$$s+nt+v \tag{1}$$

where nt is the effective optical distance the wave travels through lens 520. Variable n is the index of refraction of lens 520. This distance is equal to the distance the radiated wave may propagate unperturbed by lens 520 from antenna feed phase center 505 to radiated wave 515, and is given by:

$$b+L \tag{2}$$

Since these two distances are equal, the following equation is formed:

$$v+nt+s=b+L \tag{3}$$

Furthermore, radiated wave 515 propagating from displaced phase center 500 travels a distance:

$$P+L=R=q+v \tag{4}$$

Thus, equation 3 simplifies to the following:

$$nt+s=q+b-P \tag{5}$$

It can be seen that:

$$p=a/\sin(\beta), \text{ and} \tag{6}$$

$$b=a/\sin(\alpha) \tag{7}$$

Snell's law at first surface 522, assuming air as the medium of the radiating wave before first surface 522, gives:

$$y=\text{arc}\sin(\sin(\theta)/n) \tag{8}$$

It can be seen that:

$$u=a[1/\tan(\beta)-1/\tan(\alpha)], \tag{9}$$

$$q=(y^2+(u+d+t\cos(\gamma)^2)^{1/2}, \text{ and} \tag{10}$$

$$s=d/\cos(\theta) \tag{11}$$

To obtain t, equation 5 is rearranged to:

$$t=(b+q-s-P)/n \tag{12}$$

and equations 6–11 are used.

Finally, the curvature of outer surface 524 of lens 520 can be determined from:

$$Y=d\tan(\theta)+(t/n)\sin(\theta) \tag{13}$$

$$X=d+t\cos(\gamma) \tag{14}$$

Figure 6:
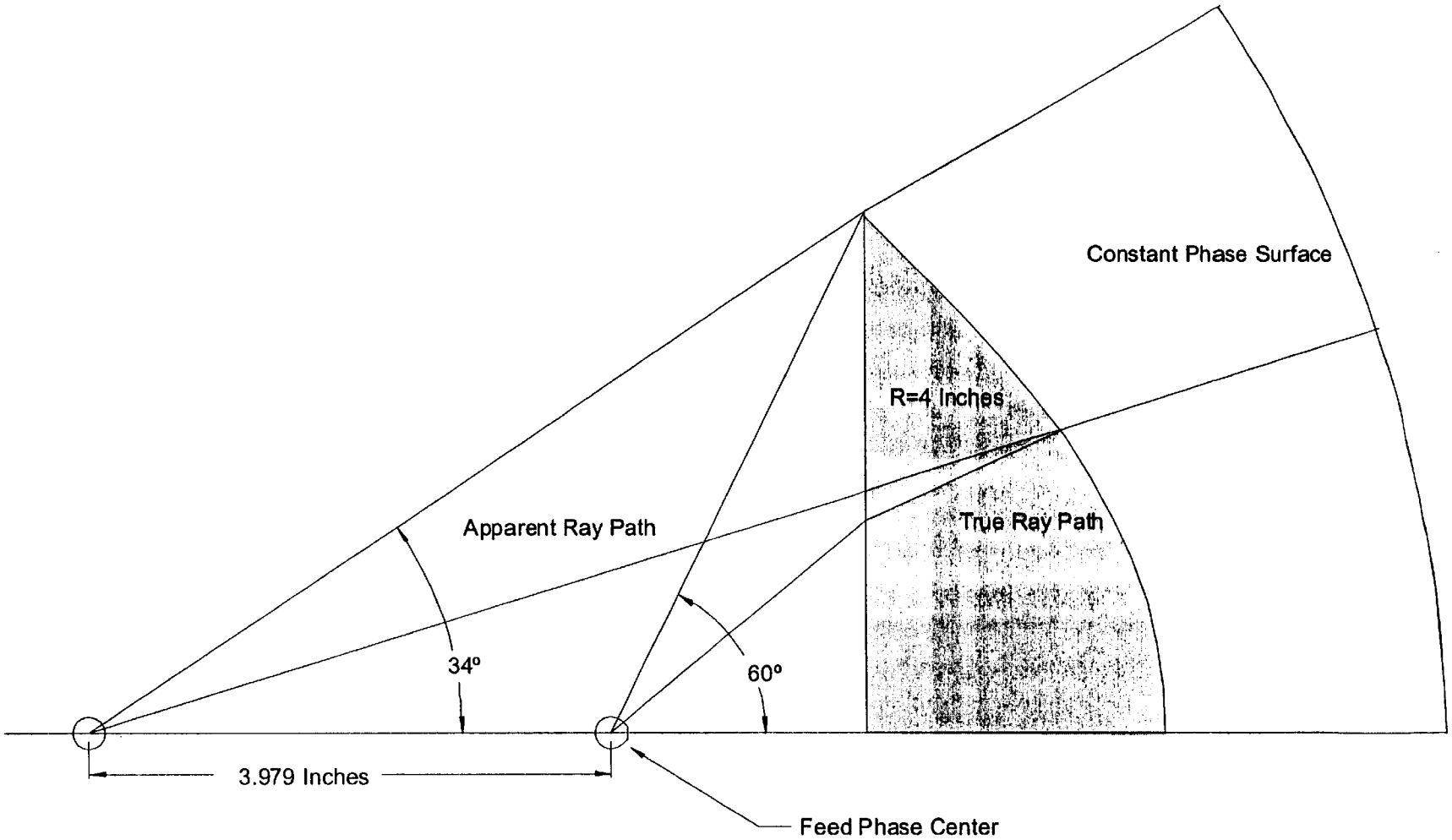
FIG. 6 is a solution diagram for one embodiment of the lens design.

In one embodiment as shown in FIG. 6, a planar convex lens may be designed to match an antenna feed beamwidth of 120 degrees to a single offset parabolic reflector angular aperture of 68 degrees. The virtual focus of lens 520 in this example is placed 3.979 inches behind antenna feed phase center 505. Thus, a radiated wave emerging from the feed at 60 degrees will be refracted by lens 520 to an angle of 34 degrees, which is the subtended aperture angle of the parabolic reflector. This may advantageously result in an optimum illumination efficiency of the antenna system.

Figure 8:
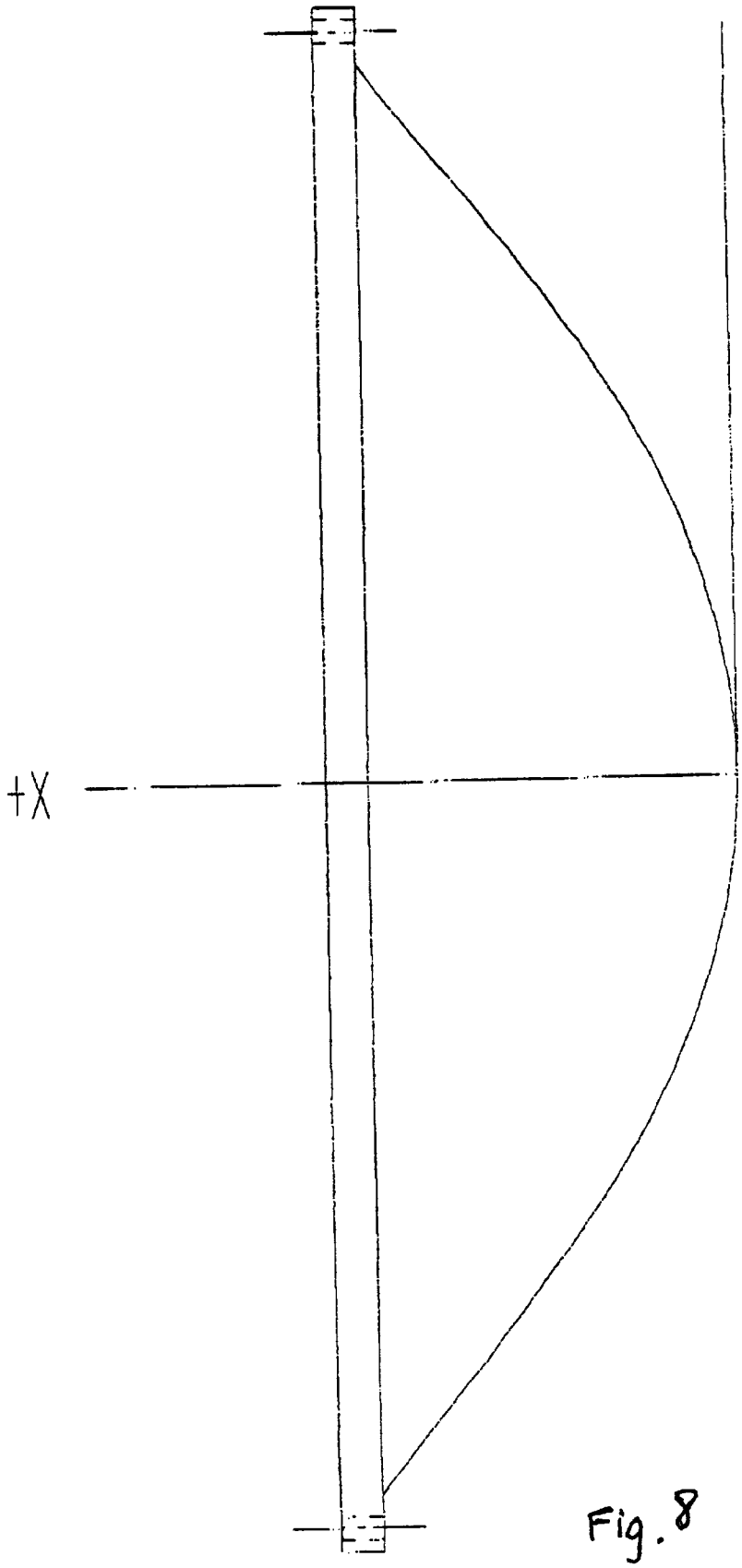
FIG. 8 is a diagram of one embodiment of the resulting lens shape from FIG. 7.
Figure 9:
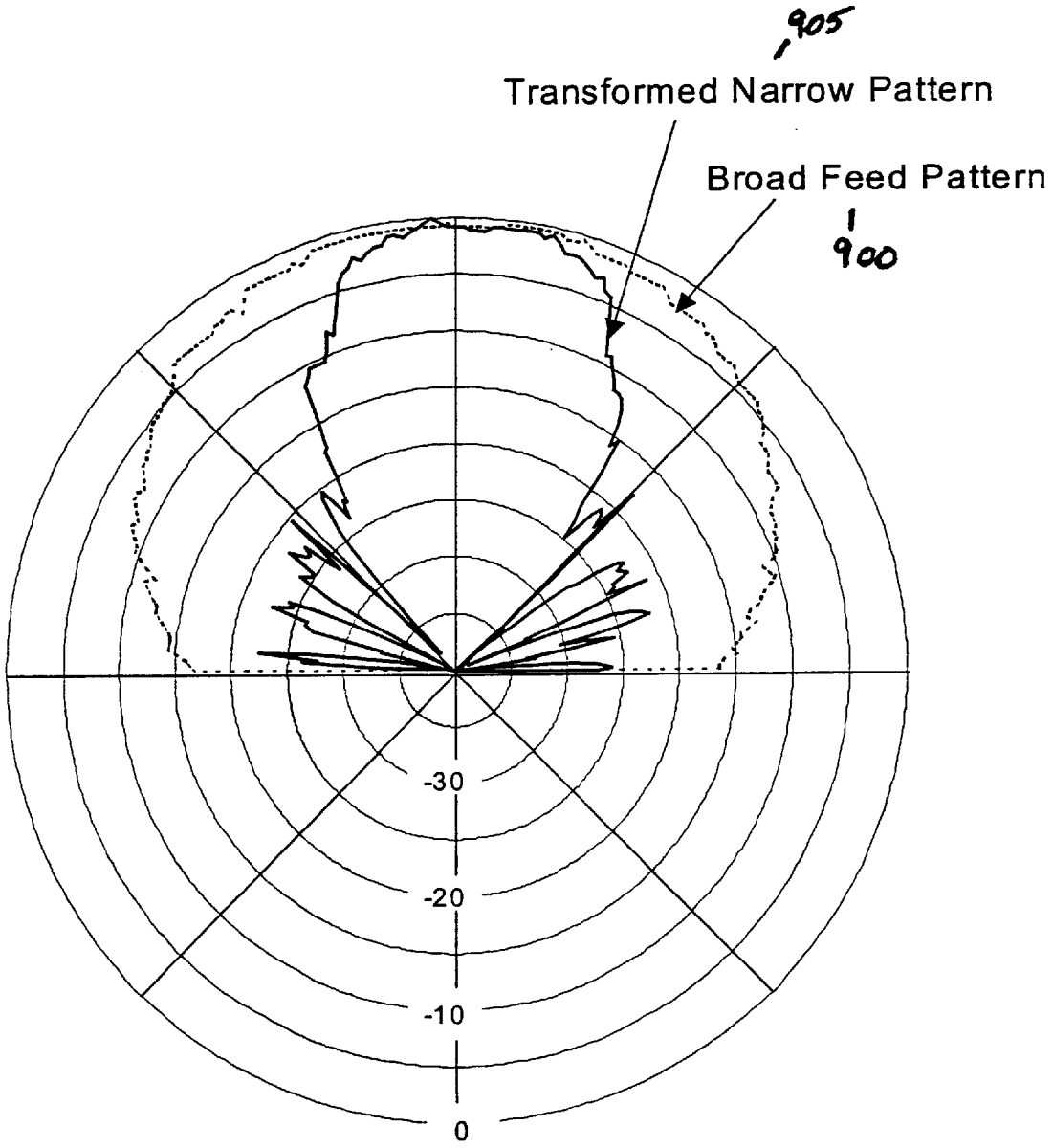
FIG. 9 is a graph of the resulting beam pattern for one embodiment of the lens design of FIG. 8.

FIG. 7 shows a table of the x and y values, in inches, for one embodiment of the planar convex lens described above. In one embodiment, an antenna system with this lens configuration may advantageously avoid generating side lobes, which may cause undesirable interference with neighboring antenna systems. FIG. 8 shows one embodiment of a planar convex lens generated from the table of FIG. 7. Furthermore, FIG. 9 shows how this lens configuration compresses a broad beamwidth 900 into a narrow beamwidth 905.

One skilled in the art will recognize the value of this lens antenna feed design and its applicability to both transmitting and receiving applications. Lens 520 may enable the implementation of a multi-band antenna feed for satellite communications at optimum illumination efficiencies across multiple operating frequencies. Different cross-sections or shapes of lens 520 may be used in diverse applications to optimally match any reflector configuration to different antenna feeds. Furthermore, employing lens 520 in a multi-band antenna feed system reduces the footprint of the system by eliminating the need for multiple antenna feeds. Lens 520 enables the use of one antenna feed to handle the multiple frequency bands desired.

Figure 10:
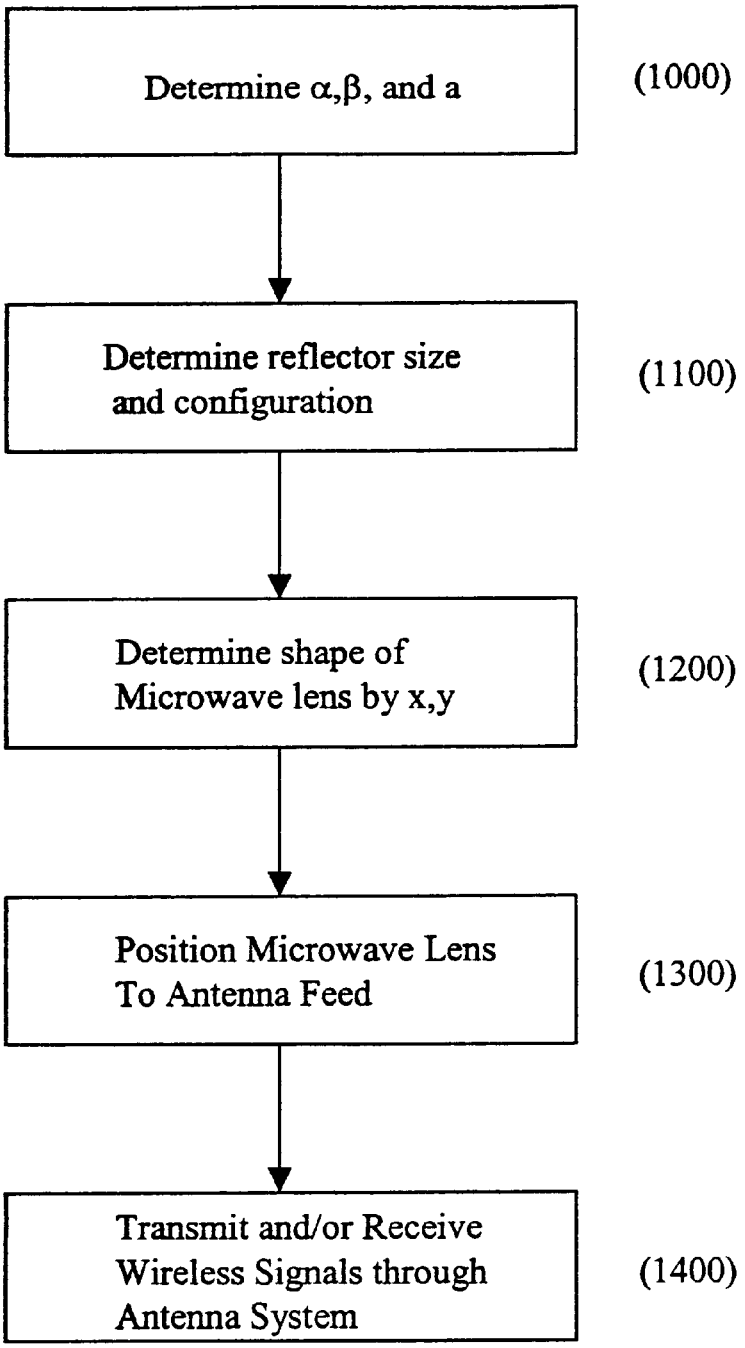
FIG. 10 is a flow diagram for one embodiment of a method for illuminating a reflector with a given feed using the lens of FIG. 6.

FIG. 10 represents one embodiment of a method for illuminating a reflector with a given feed using a lens. A designer may first obtain the known subtended angle of an antenna feed broad-band beamwidth, α, a subtended angle of the reflector aperture, β, and the radius of lens 520, a, as shown in step 1000. Next, the designer may determine the reflector configuration and size desired as shown in step 1100. The designer then determines the shape of the lens specifications (e.g., x and y) to optimally match the lens to the reflector configuration, as shown in step 1200. The designer then positions the lens in the front end of the antenna feed as shown in 1300 step. Finally, transmission and/or reception of wireless signals through this antenna system is conducted as shown in step 1400.

Figure 11:
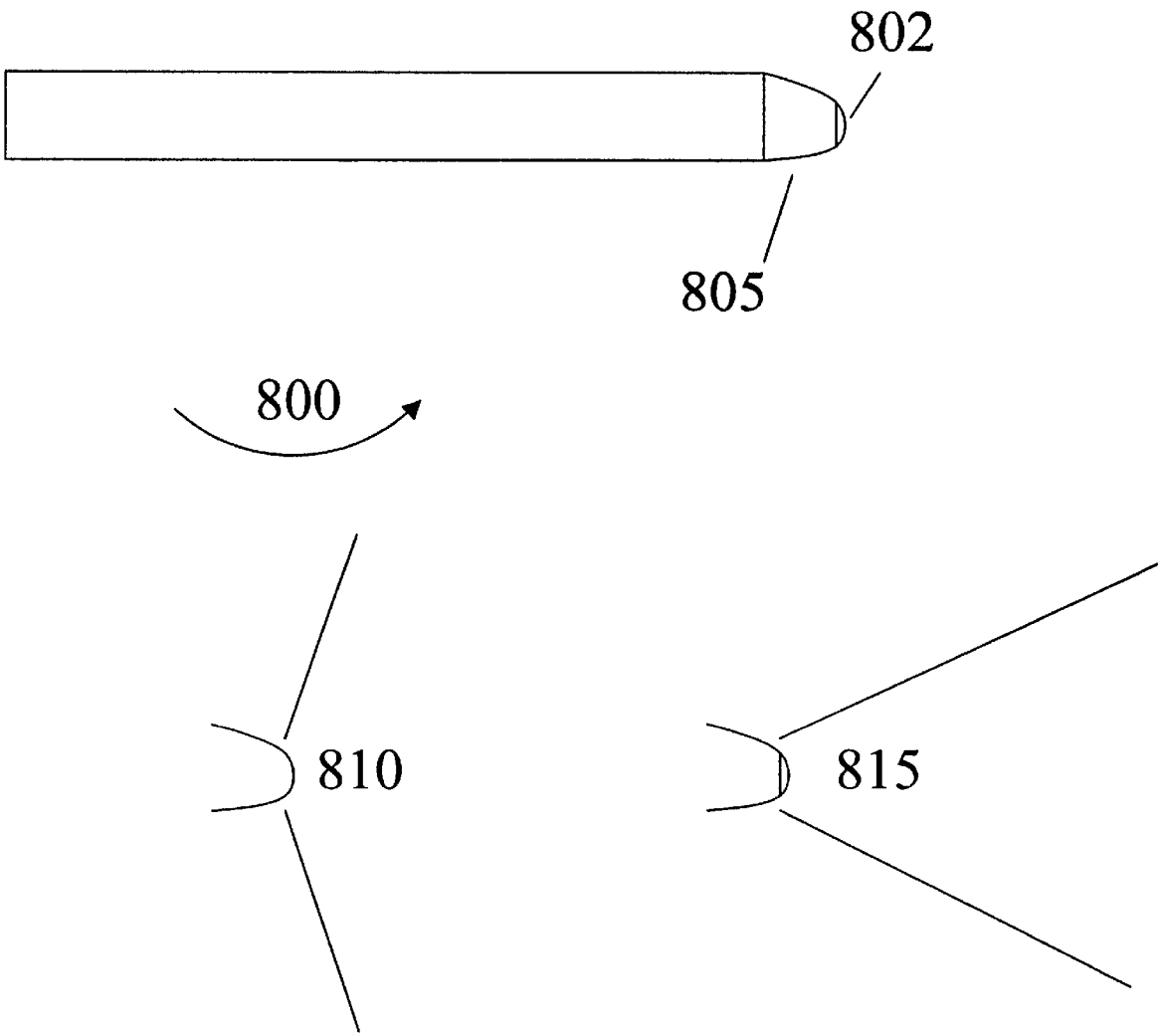
FIG. 11 is a diagram of one embodiment of a homing missile system housing a wireless sensor with one embodiment of a lens.

As previously noted, other applications of the lens are contemplated. In another embodiment, the lens antenna feed design may be used to enable higher sensitivities for a wireless sensor having a broad-band, broad-beamwidth design. FIG. 11 shows one embodiment of this system employed in an anti-radiation missile 800. The cone 805 of missile 800 comprises a lens 802 designed to decrease the width of look angle 810 to width 815, when employing lens 802. Accordingly, narrowing the width of look angle 810 to width 815 may increase the gain of the signal being detected.

Advantageously, anti-radiation missile 800 may be able to detect electromagnetic radiation sources at farther distances and may be able to detect lower level electromagnetic radiation sources. In some embodiments, lens 802 may be an integral part of nose cone 805 such that nose cone 805 comprises substantially of lens 802. This may reduce the weight of missile 800 while improving the sensor's efficiency. In this design, the shape of the lens could be adjusted to weight considerations of improvements in sensor efficiency with aerodynamics. This application may also be useful in avionics applications (e.g., for the nose cone of aircraft) or submarine applications (e.g., for the nose cone of a submarine). In another embodiment, lens 802 may be applied to short range wireless sensors, i.e., lens 802 may widen the look angle of the sensor to cover more sensing area. This may be particularly useful for short range missile applications where a wide field of view is advantageous.

Other applications are also possible and contemplated. For example, a set of two or more lenses may be used in combination (e.g., with one or more reflectors) to further optimize the pattern beamwidth of antenna feeds and/or to focus incoming wireless signals.

What is claimed is:

1. A method for transmitting a broadband wireless signal, the method comprising:

generating a broadband wireless signal with an antenna feed;

propagating the broadband wireless signal through a lens, wherein the lens is configured to focus the broadband wireless signal in a non-collimating manner; and reflecting the focused broadband wireless signal with a reflector.

2. The method as recited in claim 1, wherein the method further comprises:

reflecting a received broadband wireless signal with the reflector; and propagating the received broadband wireless signal through the lens, wherein the lens is configured to focus the broadband wireless signal in a non-collimating manner to the antenna feed.

3. The method as recited in claim 1, wherein the lens is formed of polystyrene.

4. The method as recited in claim 1, wherein the lens is formed of fused quartz.

5. The method as recited in claim 1, wherein the lens is formed of fluoropolymer.

6. The method as recited in claim 1, wherein the lens is formed of polyethylene.

7. The method as recited in claim 1, wherein the lens is meniscus.

8. The method as recited in claim 1, wherein the lens has two surfaces, wherein the first surface is substantially planar, and wherein the second surface is substantially hemispherical.

9. The method as recited in claim 1, wherein the antenna feed is a tri-feed antenna feed.

10. A system for transmitting broadband wireless signals, the system comprising:

an antenna feed configured to propagate broadband wireless signals;

a lens positioned to receive and focus the broadband wireless signals in a non-collimating manner from the antenna feed; and a reflector positioned to receive and reflect the focused broadband wireless signals from the antenna feed.

11. The system as recited in claim 10, wherein the antenna feed is configured as a point source for the broadband wireless signals, and wherein the lens is configured to change a position of the point source relative to the reflector.

12. The system as recited in claim 10, wherein the antenna feed is configured as a point source for the broadband wireless signals, and wherein the lens is configured to displace a position of the point source to a location farther from the reflector than an actual position of the point source.

13. A method for receiving a broadband wireless signal, the method comprising:

reflecting a broadband wireless signal with a reflector;

propagating the broadband wireless signal through a lens, wherein the lens is configured to focus the broadband wireless signal in a non-collimating manner; and receiving the focused broadband wireless signal with an antenna feed.

14. The method as recited in claim 13, wherein the method further comprises transmitting a second broadband wireless signal with the antenna feed.

15. The method as recited in claim 13, wherein the lens is formed of polystyrene.

16. The method as recited in claim 13, wherein the lens is formed of fused quartz.

17. The method as recited in claim 13, wherein the lens is formed of fluoropolymer.

18. The method as recited in claim 13, wherein the lens is formed of polyethylene.

19. The method as recited in claim 13, wherein the lens is meniscus.

20. The method as recited in claim 13, wherein the lens has two surfaces, wherein the first surface is substantially planar, and wherein the second surface is substantially hemispherical.

21. The method as recited in claim 13, wherein the antenna feed is a tri-feed antenna feed.

22. A system for receiving broadband wireless signals, the system comprising:

a reflector positioned to receive and reflect broadband wireless signals;

a lens positioned to receive and focus the broadband wireless signals in a non-collimating manner; and an antenna feed configured to receive the broadband wireless signals.

23. The system as recited in claim 22, wherein the antenna feed is configured as a point source for the broadband wireless signals, and wherein the lens is configured to change a position of the point source relative to the reflector.

24. The system as recited in claim 22, wherein the antenna feed is configured as a point source for the broadband wireless signals, and wherein the lens is configured to displace a position of the point source to a location farther from the reflector than an actual position of the point source.

25. A system for increasing the range of a wireless sensor, the system comprising:

a non-collimating lens configured to receive broadband wireless signals from a predetermined angle and focus the broadband wireless signals, and a wireless sensor positioned to receive the focused broadband wireless signals, wherein the predetermined angle is less than the wireless sensor's field of view angle.

26. The system as recited in claim 25, wherein the lens is part of a nose cone, and wherein the wireless sensor is part of a navigational control unit for a missile.

27. The system as recited in claim 25, wherein the lens is a nose cone, and wherein the wireless sensor is part of a navigational control unit for a missile.

28. The system as recited in claim 25, wherein the lens is formed of polystyrene.

29. The system as recited in claim 25, wherein the lens is formed of fused quartz.

30. The system as recited in claim 25, wherein the lens is formed of polyethylene.

31. The system as recited in claim 25, wherein the lens is meniscus.

32. A system for increasing the field of view of a wireless sensor, the system comprising:

a non-collimating lens configured to receive broadband wireless signals from a predetermined angle and focus the broadband wireless signals, and a wireless sensor positioned to receive the focused broadband wireless signals, wherein the predetermined angle is greater than the wireless sensor's field of view angle.

33. The system as recited in claim 32, wherein the lens is part of a nose cone, and wherein the wireless sensor is part of a navigational control unit for a missile.

34. The system as recited in claim 32, wherein the lens is a nose cone, and wherein the wireless sensor is part of a navigational control unit for a missile.

35. The system as recited in claim 32, wherein the lens is formed of polystyrene.

36. The system as recited in claim 32, wherein the lens is formed of fluoropolymer.

37. The system as recited in claim 33, wherein the lens is formed of polyethylene.

38. The system as recited in claim 32, herein the lens is meniscus.

39. A method for transmitting a broadband wireless signal, the method comprising:

generating a broadband wireless signal with an antenna feed, wherein the antenna feed is a tri-feed antenna feed configured as a source for the broadband wireless signal;

propagating the broadband wireless signal through a lens, wherein the lens has two surfaces, wherein the first surface is substantially planar, wherein the second surface is substantially hemispherical, and wherein the lens is configured to focus the broadband wireless signal in a non-collimating manner; and reflecting the focused broadband wireless signal with a reflector, wherein the lens is further configured to change a position of the source relative to the reflector.

* * * * *